US006747508B2

(12) United States Patent
Liu et al.

(10) Patent No.: US 6,747,508 B2
(45) Date of Patent: Jun. 8, 2004

(54) RESISTANCE MIRROR CIRCUIT

(75) Inventors: Jing-Meng Liu, Hsinchu (TW); Kent Hwang, Taoyuan Hsien (TW); Chao-Hsuan Chuang, Hsinchu (TW); Cheng-Hsuan Fan, Hsinchu Hsien (TW)

(73) Assignee: Richtek Technology Corp., Hsinchu Hsien (TW)

( * ) Notice: Subject to any disclaimer, the term of this patent is extended or adjusted under 35 U.S.C. 154(b) by 0 days.

(21) Appl. No.: 10/229,160

(22) Filed: Aug. 28, 2002

(65) Prior Publication Data

US 2003/0141923 A1 Jul. 31, 2003

(30) Foreign Application Priority Data

Jan. 25, 2002 (TW) ..... 91101283 A

(51) Int. Cl.[7] ..... G05F 1/10; G05F 3/02
(52) U.S. Cl. ..... 327/543; 327/541; 323/315
(58) Field of Search ..... 327/538, 540, 327/541, 543; 323/312, 313, 315, 316

(56) References Cited

U.S. PATENT DOCUMENTS 5,107,199 A * 4/1992 Vo et al. ..... 323/316
5,291,123 A * 3/1994 Brown ..... 323/369
5,572,161 A * 11/1996 Myers ..... 327/538
6,353,344 B1 * 3/2002 Lafort ..... 327/108

* cited by examiner

*Primary Examiner*—Terry D. Cunningham
*Assistant Examiner*—Quan Tra
(74) *Attorney, Agent, or Firm*—Troxell Law Office PLLC

(57) ABSTRACT

A resistance adjustable of resistance mirror circuit having a master resistor $R_0$, a reference current source terminal providing a current value $I_0$ through the master resistor $R_0$ to ground; a first transistor; a current mirror source terminal providing a current value n $I_0$, through the first transistor to ground; an operational amplifier having a positive terminal connecting to a drain of the first transistor, a negative terminal connecting to the other terminal of the master resistor $R_0$, and an output terminal connecting to a gate of the first transistor; a mirror resistor set composed of a plurality of transistors in parallel each other and having their source electrode connecting to ground. Each transistor of the mirror resistor set has a ratio of channel width over channel length being m-fold of that of the first transistor, where m, n is any positive numbers. Since gates of the transistors connect to the output terminal of the operational amplifier, each of the transistors therefore has an equivalent resistance $R_{eq}=(1/nm)R_0$.

2 Claims, 2 Drawing Sheets

RESISTANCE MIRROR CIRCUIT

FIELD OF THE INVENTION

The present invention relates to a resistance equivalent circuit, and more particularly, to an equivalent circuit of resistance mirror consisting of current mirror circuits and a mirror resistor set.

DESCRIPTION OF THE PRIOR ART

In general, to modulate the electrical characteristics of analog integrated circuits is usually by means of the resistance, capacitance or inductance adjustment. Among of them the most preferably is conducted, by adjusting the resistance for its simple, common, low cost and easy to handle.

Whereas, to achieve a specified function, for example, tuning the central frequency of multistage band pass filter circuit systems and/or sub-systems from one position to another, each sub-system should have a consistent modulation. However, if it is done by individually adjusting each resistor of the system, It would be time consuming and detrimental to the precision of the system, even more causes the circuit failed. Therefore, to overcome above-mentioned drawbacks, it is desired to have a new circuit technique for band-pass circuit that a resistance mirror circuit contains a master resistor and slave resistors. The latter is then controlled in accordance with a resistance change of the master resistor.

The object of the present is thus to provide such desired circuit.

SUMMARY OF THE INVENTION

It is therefore a primary objective of the present invention to provide a resistance mirror circuit having a set of adjustable resistors in accordance with a master resistance to meet different requirement of circuit application.

The present invention disclosed a resistance mirror circuit having a set of adjustable resistors with resistance in accordance with a master resistor. In the first preferred embodiment, the circuit comprises: (1) a master resistor $R_0$, (2) a reference current source terminal providing a current value $I_0$ through the master resistor $R_0$ to ground;(3) a first transistor; (4) a current mirror source terminal providing a current value $nI_0$, through the first transistor to ground; (5) an operational amplifier having a positive terminal connecting to a drain of the first transistor, a negative terminal connecting to the other terminal of the master resistor $R_0$, and an output terminal connecting to a gate of the first transistor; (6) a mirror resistor set consisting of a plurality of transistors in parallel each other and having their source electrodes connecting to ground. Each transistor of the mirror resistor set has a ratio of channel width over channel length being m-fold of that of the first transistor, where m, n is any positive numbers. Since gates of the transistors connect to the output terminal of the operational amplifier, each of the transistors therefore has an equivalent resistance $R_{eq}=(1/nm)R_0$.

The second embodiment according to the present invention comprises: (1) a master resistor having resistance $R_0$; (2) a first transistor, having a ratio of channel width over channel length thereof equal to W/L; (3) a reference current source terminal providing a reference current $I_0$, the reference current being through first transistor, and the master resistance $R_0$ to ground; (4) a second transistor, having a ratio of channel width over channel length thereof equal to nW/L; (5) a third transistor having a ratio of channel width over channel length thereof equal to W/L; (6) a current mirror source terminal providing a mirror current value of $nI_0$, in series connecting with the second transistor, the third transistor to ground, wherein the second transistor has a gate electrode connecting to a drain electrode, therefore the second transistor has the same current density and $V_{GS}$ voltage as the first transistor, where $V_{GS}$ voltage is voltage of the gate electrode to source electrode; (7) a mirror resistor set consisting of a plurality of transistors in parallel and with their source electrode connecting to ground, and each transistors having a ratio of channel width over channel length thereof equal to m W/L, wherein m are positive number; (8) an operational amplifier having a positive terminal connecting to a drain and a gate electrode of the second transistor, and output a signal to a gate of the third transistor and all gate electrodes of the transistors of the mirror resistor set; (9) a reference signal controlling a gate bias of said first transistor and feeding to a negative terminal of said operational amplifier so that a voltage across the master resistor $R_0$ is equal to the source voltage of the second transistor, therefore, each transistor of the mirror resistor set has an equivalent resistance $R_{eq}=(1/nm)R_0$.

The transistors in the present invention are not limited in depleted mode transistors or enhanced transistors.

DESCRIPTION OF THE PREFERRED EMBODIMENT

The present invention discloses a resistance mirror circuit consisted of a current mirror circuit, an operational amplifier and a mirror resistor set. The mirror resistor set consisting of a plurality of transistors. Each of the transistors is to work in the ohmic region and thus functions as a resistor with resistance in accordance with a master resistor. Therefore, any resistance corresponding to each transistor desired to change, is merely to change resistance of the master resistor. Thus, the present invention is especially available for those bandpass multi-steps filter integrated circuit which is designed with adjustable band frequency.

Figure 1:
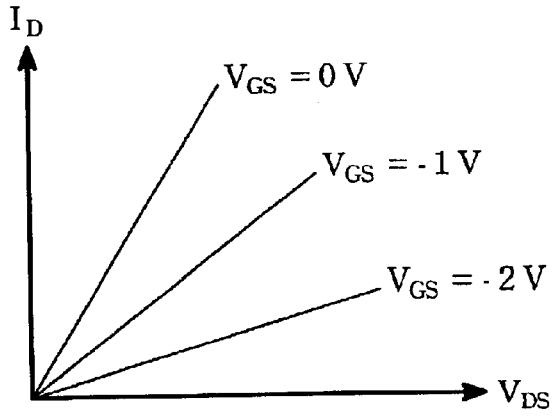
FIG. 1 shows the relationship between a drain current ($I_D$) and a voltage of drain to source ($V_{DS}$) in an ohmic region of a field effect transistor.

FIG. 1 shows a linear relationship of $I_D$ (drain current) versus $V_{DS}$ (voltage of drain to source) for a field effect transistor (or metal oxide semiconductor transistor) while $I_D$ and $V_{DS}$ are small. The slopes of curves are varied with $V_{GS}$, voltage of gate to source.

The curves shown in FIG. 1, is an example of a depleted-type field effect transistor. The slope, said the conductance is maximum or said resistance is minimum when $V_{GS}=0$. On the contrary, for enhanced-type field effect transistor, the larger the $V_{GS}$ is, the smaller resistance will be. Therefore, if the gate voltage is properly adjustment, no matter the depleted-type or enhanced-type field effect transistor is employed, the transistors can be served as adjustable resistors.

The present is thus utilized the linear region of $V_{DS}$ and $I_D$ curve of the transistor, in the linear region, the $R_{DS}$, the equivalent resistance of drain to source is:

$$R_{DS}=V_{DS}/I_D$$

Where, $I_D=K(W/L)(V_{GS}-V_{TH})V_{DS}$, then:

$$R_{DS}=V_{DS}/I_D=1/K(L/W)(V_{GS}-V_{TH})^{-1}$$

where $V_{TH}$: a threshold voltage;

Accordingly, $R_{DS}$ is a function of $V_{GS}$ so $R_{DS}$ of one or several transistors is adjusted in response to a proper $V_{GS}$ adjustment by means of a feedback circuit. In the situation, $R_{DS}$ is linear proportional to the predetermined resistor $R_0$. In other words, the resistance $R_{DS}$ of transistor can be varied in response to a predetermined resistor, or say master resistor $R_0$ in feedback circuit.

Figure 2:
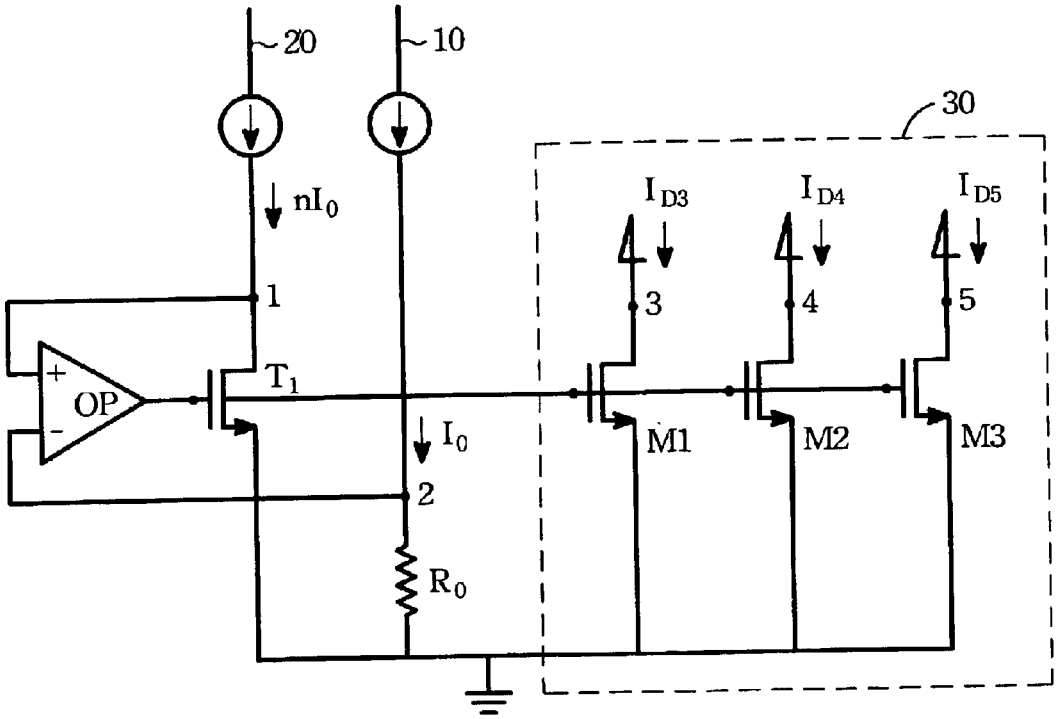
FIG. 2 is schematic drawing of a resistance mirror circuit having resistance adjustable according to the first embodiment of the present invention.

Please refer to FIG. 2, a view of a resistance mirror circuit according to the first embodiment of the present invention. The resistance mirror circuit comprises (1)a current mirror source, (2) a plurality of transistors M1, M2, and M3 worked in the ohmic region, (3) an operational amplifier OP, a transistor T1 and a master resistor $R_0$. The current mirror source, has a current reference source 10 providing a reference current $I_0$, which passes through a node 2 and the master resistor $R_0$ to ground and, a current mirror source 20 providing a mirror current $nI_0$, n is any positive number, sinking to ground via the transistor T1 which has a ratio of channel width over channel length (W/L) equal to x. The transistors M1, M2, and M3 are in parallel and with source terminals connected to ground; The output terminal of the operational amplifier OP provides an input signal and feeds to transistor T1 and transistors M1, M2, and M3 through gate electrodes to provide a proper gate bias. Furthermore, signal from the drain terminal (node 1) of the transistor $T_1$ (node 1) is feedback to the positive terminal of the operational amplifier OP thereto provides an input signal. And the negative terminal of the operational amplifier op connects to the node 2 of the reference current source terminal 10.

The resistor $R_0$ connected to the node 2 is to function as a master resistor. In other words, if a resistance of the master resistor $R_0$ is changed, resistances of all mirror resistors 30 are followed. Since the voltage ($V_2$) of the node 2 is equal to $I_0R_0$ and feedbacks to the negative terminal of the operational amplifier OP without connecting any resistor, As a result, the relationships as follows are established:

$$V_1=V_2=I_0R_0$$

Therefore, the equivalent resistance of the transistor $T_1$ is:

$$R_{eqT1}=V_1/nI_0=(1/n)R_0$$

Furthermore, since the gates of the transistors $M_1$, $M_2$, $M_3$ connect to the gate of the transistor $T_1$ and, the transistors $M_1$, $M_2$, $M_3$ have a channel width over channel length=mx, where x=W/L of the transistor $T_1$. Consequently, for the drain current $I_{D2}$ at node 1, of the transistor $I_{D2}=nI_0$, the drain current $I_{D3}$, $I_{D4}$, $I_{D5}$ at node 3, 4, and 5 are:

$$I_{D3}=I_{D4}=I_{DS}=mnI_0.$$

Each transistor M3, M4, and M5 in mirror resistor set 30 has an equivalent resistance:

$$R_{eqM1}=R_{eqM2}=R_{eqM3}=V_1/nmI_0=(1/nm)R_0$$

Figure 3:
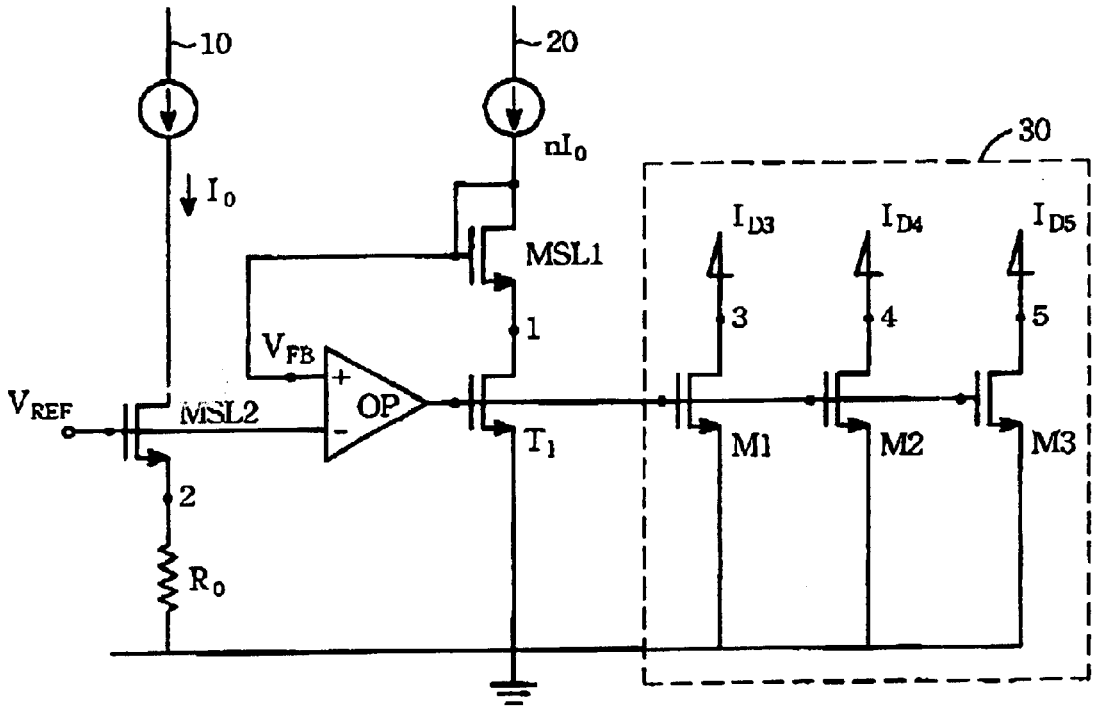
FIG. 3 is schematic drawing of a resistance mirror circuit having resistance adjustable according to the second embodiment of the present invention.

The second embodiment of resistor mirror circuit according to the present invention is disclosed in FIG. 3. Please refer to FIG. 3 the resistance mirror circuit comprises: (1) a current mirror circuit 10, 20, (2) an operational amplifier OP, (3) a first transistor MSL2, (4) a second transistor $MSL_1$ (5) a third transistor $T_1$, (6) a master resistor $R_0$ and (7) a mirror resistor set 30. The reference current source terminal 10 of the current mirror circuit provides constant reference current $I_0$, and the mirrored current source 20 provides a current of about n-fold of $I_0$. The reference current 10 from reference current source 10 is through the first transistor $MSL_2$, node 2, and the master resistor $R_0$ to ground. The current mirror source 20 is through the second transistor $MSL_1$ and the third transistor $T_1$ to ground. The second transistor $MSL_1$ has a channel width over channel length ratio being n-fold of that of the first transistor $MSL_2$.

The mirror resistor set 30 is composed of a plurality of transistors M1, M2, M3, in parallel, as is shown in FIG. 3, having their source electrode connection to ground and having a channel width over channel length ratio of about m times of that of the third transistor $T_1$, where n, m are any positive numbers.

Moreover, the drain and the gate terminal of the second transistor $MSL_1$ are connected together and then negative feedback to the positive input terminal of the operational amplifier OP. The output terminal of the operational amplifier OP is connected to the gates of the third transistor T1. The negative terminal thereof is under controlled by a reference voltage signal $V_{REF}$, as shown in FIG. 3. Due to the negative feedback characteristic of the operational amplifier OP, the voltage $V_{FB}$ is almost the same voltage as the reference voltage $V_{REF}$. In addition, the reference voltage signal $V_{REF}$ also controls the gate bias of the first transistor $MSL_2$. Therefore, the $V_{GS}$ of the first transistor $MSL_2$ is equal to that of the second transistor MSL1 when the current densities of these two transistors are identical. This is because the second transistor $MSL_1$ has a channel width over channel length ratio being n-fold of that of the first transistor $MSL_2$, and a constant current of the terminal of current mirror source 20 is also n-fold of that of the terminal of current reference source 10. The difference between the voltage $V_2$ of the node 2 and reference voltage signal $V_{REF}$ is only $V_{GS}$ of the first transistor $MSL_2$, that is, the voltage $V_2$ at node 2 is equal to the voltage $V_1$ at node 1. Consequently, as the foregoing description of the first embodiment, each transistor $M_1$, $M_2$, $M_3$ in the mirror resistors set has an equivalent resistance value:

$$R_{eqM1}=R_{eqM2}=R_{eqM3}=V_1/nmI_0=(1/nm)R_0$$

The benefits of the present invention are:

Resistance of each resistor in mirror resistor set is adjustable according to the master resistor and has an equivalent resistance value of $R_{eqM}=(1/nm)R_0$. It is thus easier and benefit to employ the resistance mirror circuit in multistage band pass filter circuits composed of the RC or RLC demanded with central frequency modulation.

Although the preferred embodiments have been described in some detail, the present invention is not limited therein, other modifications and alternations without departing from the spirit a scope of the present invention should be construed by the appended claim.

What is claimed is:

1. A resistance mirror circuit having a set of adjustable resistors, said resistance mirror circuit comprising:

a master resistance $R_0$;

a first transistor, having a ratio of channel width over channel length thereof equal to W/L;

a reference current source terminal providing a reference current with a value of $I_0$, said reference current being through said first transistor, and said master resistance $R_0$ to ground;

a second transistor, having a ratio of channel width over channel length thereof equal to n W/L;

a third transistor having a ratio of channel width over channel length thereof equal to W/L;

a current mirror source terminal providing a mirror current value of $nI_0$, in series connecting with said second transistor, said third transistor to ground, wherein said second transistor has a gate electrode connecting to a drain, therefore said second transistor has the same current density and $V_{GS}$ voltage as said first transistor, where $V_{GS}$ voltage is a voltage drop between said gate electrode and said source electrode;

a mirror resistor set consisting of a plurality of transistors in parallel and with their source electrode connecting to ground, and each said transistors of said mirror resistor set having a ratio of channel width over channel length thereof equal to m W/L, wherein m are positive number;

an operational amplifier having a negative terminal connecting to a drain electrode of said second transistor, and outputting a signal to a gate of said third transistor and all gate electrodes of said transistors of said mirror resistor set; and a reference signal controlling a gate bias of said first transistor and feeding to a positive terminal of said operational amplifier so that a voltage across said master resistor $R_0$ is equal to said source voltage of said second transistor, therefore, each transistor of said mirror resistor set having an equivalent resistance $R_{eq}=(1/nm)R_0$.

2. The resistance mirror of claim 1 wherein said transistors of mirror resistor set are selected from depleted-type field effect transistors or enhanced-type field effect transistors.

* * * * *